US005850856A

United States Patent [19]

Olson

[11] Patent Number: 5,850,856

[45] Date of Patent: Dec. 22, 1998

[54] GASOLINE DISPENSER WITH INTEGRAL, INTERNAL SELF POWERED VAPOR RECOVERY PUMP

[75] Inventor: Scott M. Olson, Grand Rapids, Mich.

[73] Assignee: Delaware Capital Formation, Inc., Wilmington, Del.

[21] Appl. No.: 732,743

[22] Filed: Oct. 18, 1996

[51] Int. Cl.[6] ..... B65B 31/00

[52] U.S. Cl. ..... 141/59; 141/290

[58] Field of Search ..... 141/44, 45, 59, 141/290

[56] References Cited

U.S. PATENT DOCUMENTS

| | | | |
|---|---|---|---|
| 2,291,856 | 8/1942 | Willson | 103/135 |
| 2,671,462 | 3/1954 | Grier | 137/88 |
| 3,016,928 | 1/1962 | Brandt | 141/45 |
| 3,178,102 | 4/1965 | Grisbrook | 230/139 |
| 3,181,729 | 5/1965 | Milonas et al. | 222/36 |
| 3,198,126 | 8/1965 | Minich | 103/118 |
| 3,291,384 | 12/1966 | Garland et al. | 230/152 |
| 3,748,068 | 7/1973 | Keller | 418/137 |
| 3,850,208 | 11/1974 | Hamilton | 141/59 |
| 3,981,335 | 9/1976 | Deters | 222/318 X |
| 4,068,687 | 1/1978 | Long | 141/59 |
| 4,090,539 | 5/1978 | Krupp | 141/290 |
| 4,295,802 | 10/1981 | Peschke | 417/405 |
| 4,687,033 | 8/1987 | Furrow et al. . | |
| 4,799,940 | 1/1989 | Milllikan . | |
| 5,038,838 | 8/1991 | Bergamini et al. . | |
| 5,150,742 | 9/1992 | Motoashi et al. . | |
| 5,199,471 | 4/1993 | Hartman et al. . | |
| 5,203,384 | 4/1993 | Hansen . | |
| 5,213,142 | 5/1993 | Koch et al. . | |
| 5,234,036 | 8/1993 | Butkovich et al. . | |
| 5,297,594 | 3/1994 | Rabinovitch . | |
| 5,341,855 | 8/1994 | Rabinovitch . | |
| 5,392,824 | 2/1995 | Rabinovitch . | |
| 5,394,909 | 3/1995 | Mitchell et al. . | |
| 5,417,256 | 5/1995 | Hartsell, Jr et al. | 141/45 |
| 5,575,629 | 11/1996 | Olson et al. . | |
| 5,636,667 | 6/1997 | Young et al. | 141/59 |

FOREIGN PATENT DOCUMENTS

| | | |
|---|---|---|
| 798 867 | 8/1973 | Belgium . |
| 0 022 103 | 1/1981 | European Pat. Off. . |
| 0 480 088 A1 | 4/1992 | European Pat. Off. . |
| 1 628 275 | 8/1970 | Germany . |
| 29 05 044 | 8/1979 | Germany . |
| WO 95/30091 | 11/1995 | WIPO . |

OTHER PUBLICATIONS

Pp. 4–29 and 4–30 of "Handbook of Plastics and Elastomers"; Charles Harpre; copyright 1975 by McGraw–Hill, Inc.

*Primary Examiner*—Steven O. Douglas
*Attorney, Agent, or Firm*—Flynn, Thiel, Boutell & Tanis, P.C.

[57] ABSTRACT

A liquid fuel dispenser having a vapor recovery pump mounted within the dispenser on a wall to protect the vapor recovery pump from weather damage and intentional or accidental mischief. The vapor recovery pump having a bulkhead attached thereto with a vapor recovery passage and a fuel supplying passage being positioned thereon. Both passages extending from an outlet in the bulkhead to their respective pump or motor chambers in said vapor recovery pump. The outlet being in fluid communication with a coaxial fuel hose. The bulkhead having a standoff section, in which the outlet is positioned, being substantially axially aligned with an outlet of the motor chamber. The standoff section mounts on the wall of the dispenser. A coupling boss is positioned on the standoff section for abutting the wall.

24 Claims, 5 Drawing Sheets

GASOLINE DISPENSER WITH INTEGRAL, INTERNAL SELF POWERED VAPOR RECOVERY PUMP

FIELD OF THE INVENTION

This application relates generally to a gasoline dispenser and, more particularly, to a gasoline dispenser with an internal, integral vapor recovery pump for drawing in the volatilized petroleum products generated during the gasoline dispensing process.

BACKGROUND OF THE INVENTION

A gasoline dispenser is the actual unit at a gasoline station from which fuel is supplied to a vehicle. A gasoline dispenser typically has a flow control valve that regulates the flow of the gasoline, or other fuel, from a storage tank. A gasoline dispenser also has a flow meter that provides an indication of the volume of fuel that is discharged in a given dispensing operation. In modern dispensers, a small processing circuit and display integral with the flow meter provide an indication of both the volume of the fuel that has been discharged as well as indication of the cost of the fuel.

An inevitable result of the discharge of fuel into the fuel tank of a vehicle is that some of the constituent components of the fuel volatilize into a vapor. Unless these vapors are captured, they escape into the atmosphere where they contribute to environmental pollution. In order to minimize the emission of fuel vapors into the atmosphere, and the pollution they cause, many regulatory authorities are now requiring that gasoline dispensers be provided with vapor recovery systems that capture these vapors as soon as they are released in order to minimize the extent of their release into the ambient environment. In most vapor recovery systems these vapors, upon being captured, are returned to the storage tank wherein they were originally stored as liquid-state fuel. Thus, vapor recovery systems have been found to not only control pollution, they also recycle vaporized fuel so it can be returned to a vehicle as useable fuel.

In one popular type of vapor recovery system, each gasoline dispenser is provided with a fluid-driven vapor recovery pump and a coaxial dispensing hose. The vapor recovery pump is arranged so that as fuel is discharged from the dispenser, it flows through the pump and causes a vacuum to develop in a pump chamber. Both the fuel outlet port and the vapor inlet port of the vapor recovery pump are connected to different lines of the dispensing hose. The outer, annular line internal to the hose serves as the conduit through which the gasoline is discharged to a vehicle. The center line internal to the hose serves as a conduit through which vapor discharged during the fueling process is drawn back into the fuel storage tank. Consequently, as a result of the dispensing process, the movement of the fuel through the vapor recovery pump causes the pump to develop a suction. This suction developed by the pump causes the fuel vapors, as soon as they develop, to be drawn into the vapor recovery pump. From the vapor recovery pump, the vapor is returned to the fuel storage tank. An advantage of providing a gasoline dispenser with a fluid-driven vapor recovery pump is that the motive power for the pump is inevitably developed as a result of the discharge of the fuel. Moreover, the pump is activated at the start of the fuel dispensing processes, stays active while the fuel is being dispensed and automatically shuts off with the cessation of the fuel dispensing. Thus, there is no need to provide these vapor recovery pumps with either a source of electrical power so that they can be energized, or a control system to ensure that they are actuated when their use is required but are otherwise kept in a deactivated state. A more complete discussion of the construction of one such fluid-driven vapor recovery pump is found in U.S. patent application Ser. No. 08/236 205, filed May 2, 1994, now U.S. Pat. No. 5,575,629.

While current fluid-driven vapor recovery pumps are useful for capturing fuel vapors, it has proved difficult to install these pumps in the gasoline dispensers with which they are employed. There have been some efforts made to mount these pumps internally to the associated dispensers. A disadvantage of these arrangements is that it has required the installation of mounting brackets internal to the dispenser in order to hold the pump in place. Moreover, after a coaxial fuel/vapor line is coupled to a dispenser, the fuel and vapor lines are separated from each other. Consequently, having to connect four lines to a vapor recovery pump, two fuel lines and two vapor lines, inside a dispenser has significantly contributed to the clutter inside the dispenser. Thus, overall the placement of the vapor recovery pump and the associated fuel and vapor lines has significantly added to the overall complexity of the components found in a gasoline dispenser.

There have also been attempts to position the fluid-driven vapor recovery pumps outside the dispenser. Typically, these pumps are placed near the base of the associated dispenser and are further placed in their own housings. One disadvantage of this arrangement is that it is usually necessary to provide some sort of mounting bracket in order to secure the vapor recovery pump in place. Still another difficulty with this arrangement is that even though the vapor recovery pump is contained in its own housing, it may still be subjected to environmental elements such as rain and snow. Over time, the exposure to these elements may damage the components forming a pump. Moreover, by being located external to the associated fuel dispenser, there is a risk that the vapor recovery pump can be damaged either accidently by an individual fueling his/her vehicle or, deliberately, by a person interested in vandalism or attempting to steal fuel.

SUMMARY OF THE INVENTION

This invention is directed to a fuel dispenser with an internal fluid-driven vapor recovery pump that is attached directly to the dispenser in order to directly receive a coaxial fuel delivery/vapor recovery hose.

BRIEF DESCRIPTION OF THE DRAWINGS

This invention is described with particularity in the appended claims. This invention is described in forgoing detailed description taken in conjunction with the accompanying drawings in which:

DETAILED DESCRIPTION

Figure 1:
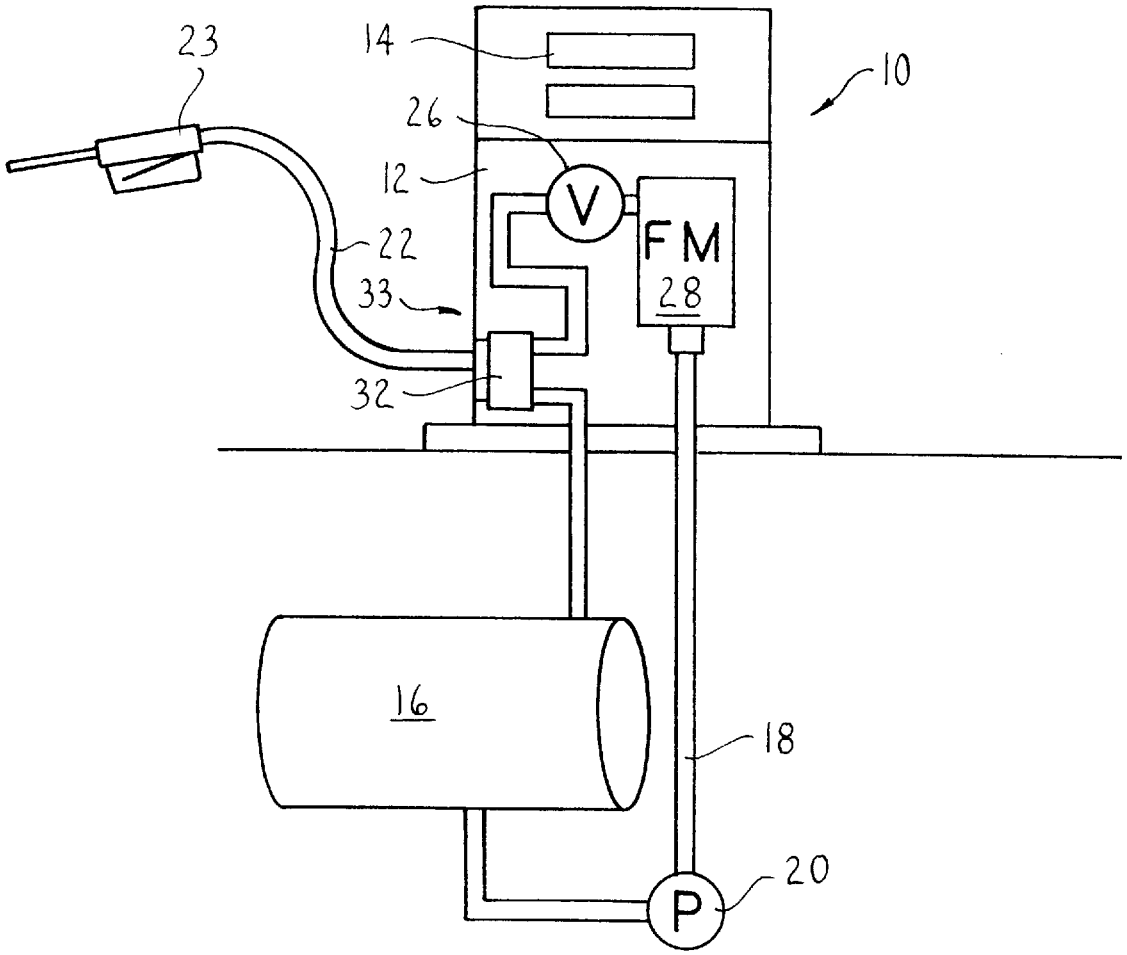
FIG. 1 depicts a gasoline dispenser of this invention.

FIG. 1 depicts a gasoline dispenser 10 constructed in accordance with this invention. Dispenser 10 includes a housing 12 which contains the internal components forming the dispenser. A display/control panel 14 is attached to the top of the housing 12. The display/control panel 14 typically is arranged to: allow the customer to select the type of fuel to be dispensed; indicate the volume of the dispensed fuel and its price; and allow the customer to pay for the fuel using a bank card. The fuel itself is stored in an underground storage tank 16. A delivery pipe 18 runs from the base of the tank 16 to the dispenser 10. A suction pump 20 mounted in the delivery pipe 18 or the base of the storage tank 16 forces the fuel to the dispenser.

The fuel is discharged from the dispenser through a hose 22. The dispensing process is controlled by a nozzle 23 on the end of the hose 22. Hose 22 is a two-line coaxial hose having an outer annular line 24 (FIG. 5) through which fuel is discharged to the vehicle and an inner line 25 (FIG. 5) through which vapor driven off during the dispensing process is returned to the dispenser 10 and storage tank 16. The fuel flow from the storage tank 16 is controlled by a valve 26 located in the dispenser. When the dispenser 10 is actuated, the valve 26 is opened to allow the fuel forced from the storage tank 16 to flow through the hose 22 and out the nozzle 23. A flow meter 28 is series connected to the delivery pipe 18 so as to be located immediately upstream from valve 26. Flow meter 28 provides a volumetric measure of the amount of fuel discharged by the dispenser during each dispensing cycle. This volume, along with the associated cost of the dispensed fuel, is presented to the customer on the display/control panel 14. A processor, not illustrated, performs the requisite volume-to-price data calculations as well as the other data recording and data reporting steps needed to ensure payment of the fuel.

A fluid-driven vapor recovery pump 32 is mounted inside the dispenser 10. More specifically, vapor recovery pump 32 is mounted directly to a side wall 33 of the housing 12 so as to partially extend through the housing. The hose 22 is connected directly to the vapor recovery pump 32 immediately adjacent the outer surface of the housing.

Figure 2:
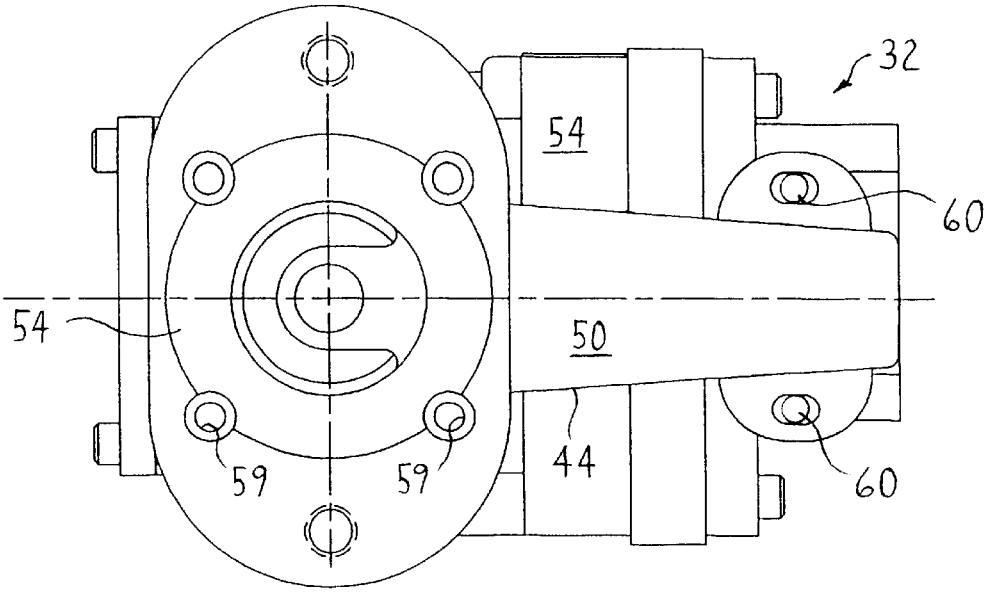
FIG. 2 is a plan view of the fluid-driven vapor recovery pump that is part of the gasoline dispenser of this invention.
Figure 3:
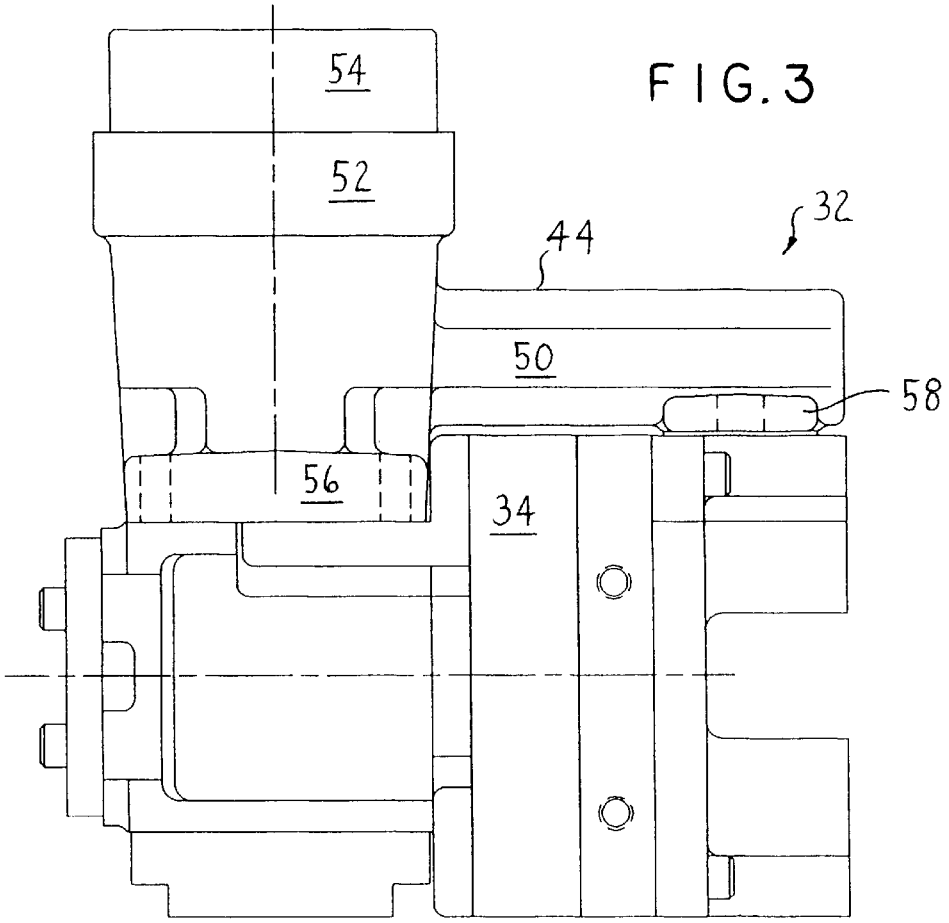
FIG. 3 is a side view of the fluid-drawn vapor recovery pump.
Figure 4:
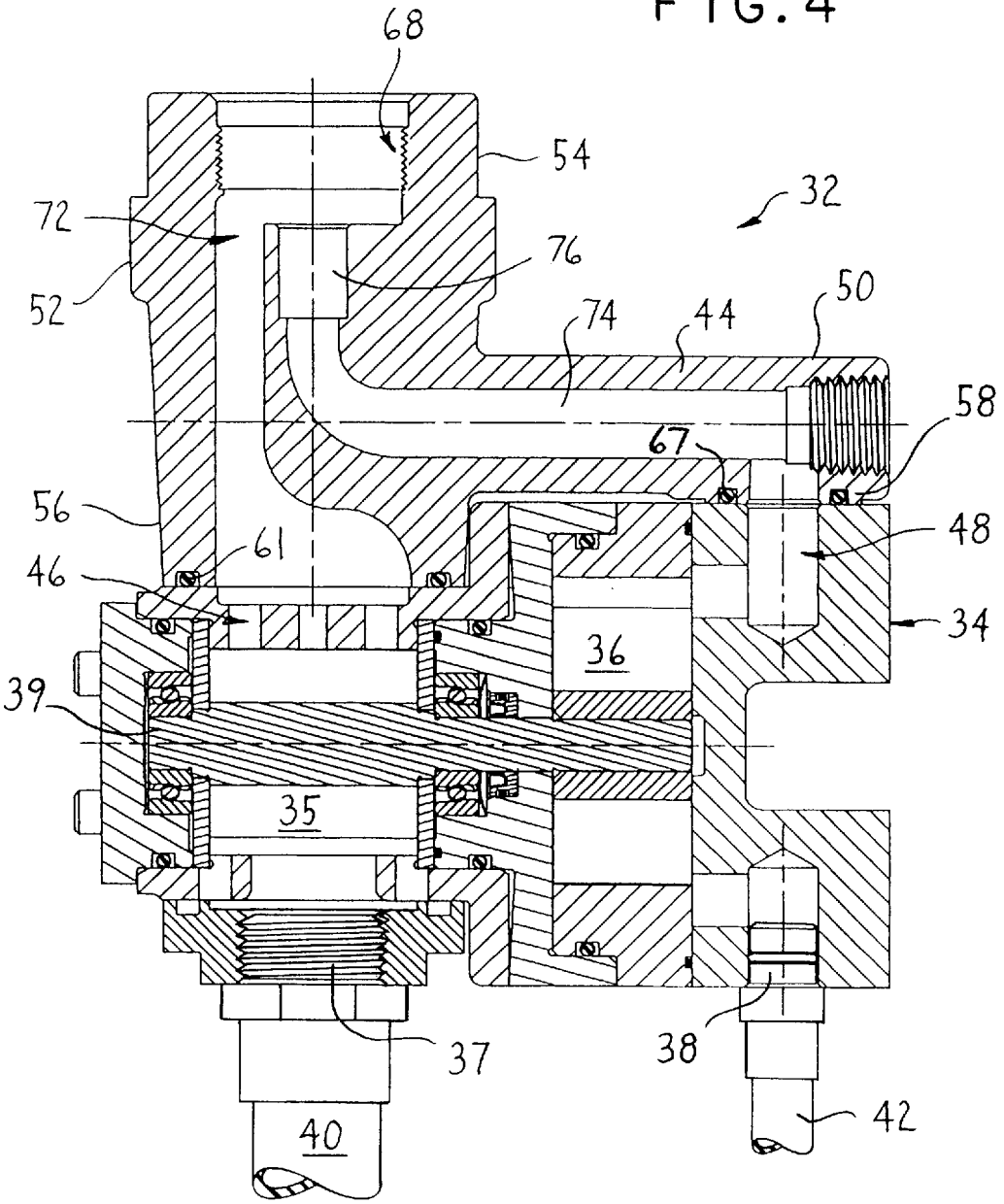
FIG. 4 is a cross sectional view of the vapor recovery pump.

Vapor recovery pump 32, as now described by reference to FIGS. 2–4, has a main body 34 which defines a motor chamber 35 and a pump chamber 36. A more complete description of the internal structure of one such vapor recovery pump is contained in the above discussed U.S. patent application Ser. No. 08/236 205, now U.S. Pat. No. 5,575,629, which is incorporated herein by reference. The pump main body 34 is provided with a fuel inlet port 37 through which fuel is introduced into the motor chamber and a vapor outlet port 38 through which vapor drawn into the pump chamber is exhausted therefrom. The fuel is introduced into the fuel inlet port 37 from valve 26 through a fuel supply line 40. The vapor exhausted by pump 32 through exhaust port 38 is returned to the supply tank 16 through an exhaust line 42. A shaft 39 extends from motor chamber 35 to pump chamber 36. The flow of fuel through motor chamber 35 causes the shaft 39 to rotate so that a suction develops in pump chamber 36.

The fuel is discharged from the vapor recovery pump 32 and the vapor drawn into the pump 32 through hose 22. To facilitate this exchange of fluids, a bulkhead outlet fitting 44 is secured to the pump main body 34 so as to provide a fluid communication path from the motor chamber 35 and to the pump chamber 36. As best seen in FIG. 4, bulkhead outlet fitting 44 is designed to be secured to the side of the pump main body in which an outlet 46 from the motor chamber 35 and inlet 48 into the pump chamber 36 are formed. Bulkhead outlet fitting 44 has a main section 50 that extends generally along the full length of the pump main body 34. A standoff section 52 extends from the main section 50 so as to be directed away from the pump main body 34. In the depicted version of the invention, standoff section 52 is axially in line with the outlet 46 associated with motor chamber 35. A coupling boss 54 extends outwardly from the standoff section 52.

A first stepped section 56 extends inwardly from the main section 50 of the bulkhead outlet fitting 44 to the adjacent outer surface of the pump main body 34 that defines the motor outlet 46. A second stepped section 58 extends inwardly from the main section 50 to the adjacent outer surface of the pump main body 34 that defines the pump inlet 48. The bulkhead outlet fitting 44 is secured to the pump main body 34 by a first set of threaded fasteners 59 that extend through the standoff section 52, the main section 50 and the first stepped section 56. A second set of threaded fasteners 60 that extend through the main section 50 and the second stepped section 58 of the bulkhead outlet fitting 44 to further secure the fitting to the pump main body 34. An O-ring 61 seated in a notch, formed in stepped section forms a seal between the interface of pump 32 and fitting 44 around the opening associated with motor outlet 46. An O-ring 67 seated in a notch formed in main section 50 forms a seal between the interface of pump 32 and fitting 44 around the opening associated with vapor inlet 48.

Figure 5:
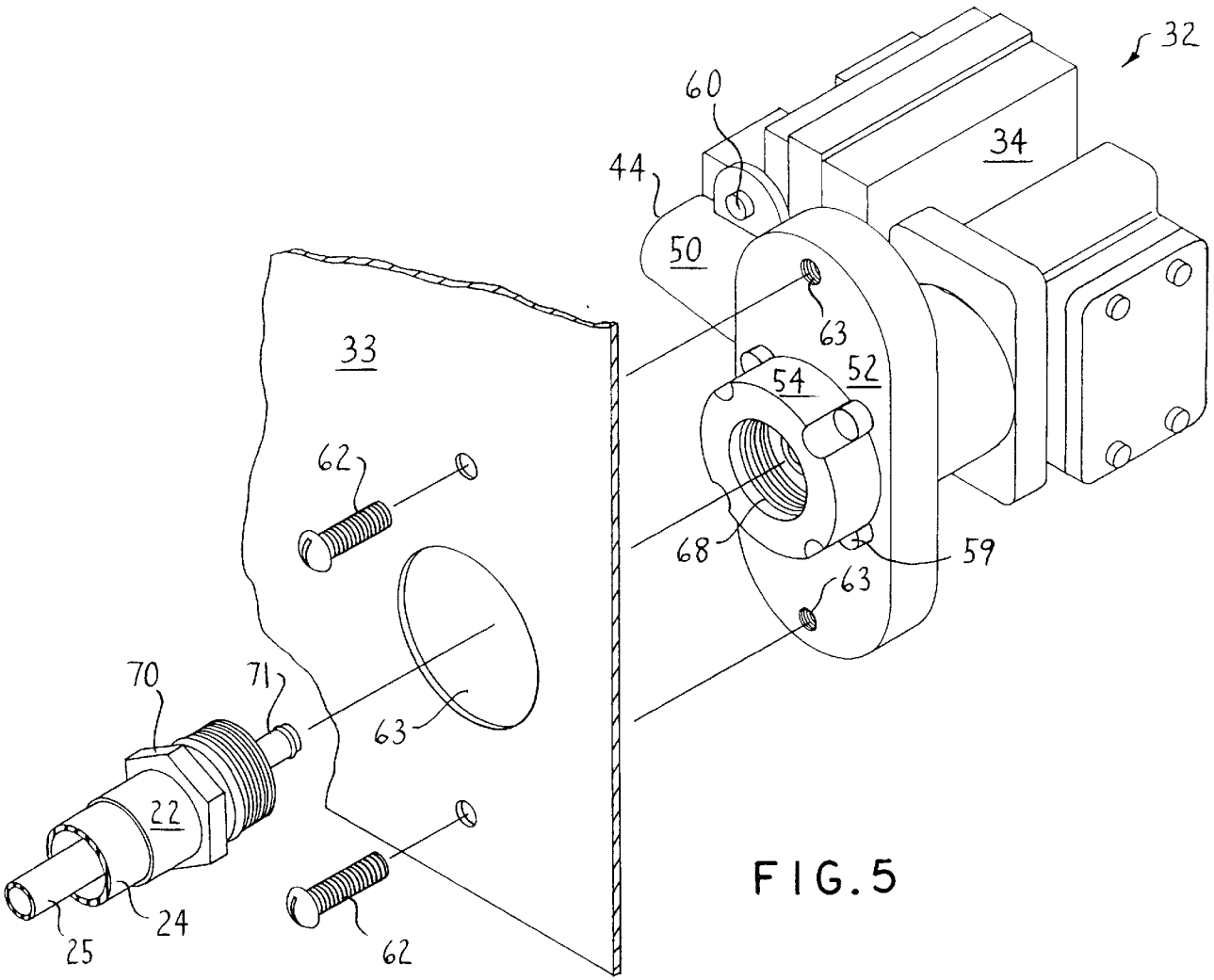
FIG. 5 is an exploded view of the vapor recovery pump and its relationship to the other components of the gasoline dispenser.

The bulkhead outlet fitting 44 is secured directly to the inside surface of the wall 33 of the dispenser housing 12 as seen best by reference to FIG. 5. (Not shown in this Figure is the cosmetic cover that is often secured over the outer surface of wall 33). The wall 33 is formed with an opening 63 through which the standoff section 52 extends so that the outer face of the standoff section 52 is pressed against the wall and the coupling boss 54 extends through opening 63. The standoff section 52 is of sufficient area to not unduly stress nor deform the wall 33 of the dispenser housing 12 by dispersing the weight of the vapor recovery pump on a greater area of the wall 33. The bulkhead outlet fitting 44 is held in place by two threaded fasteners 62 that extend through complementary holes in the wall and into threaded bores 64 formed in standoff section 52.

The standoff section 52 and boss 54 of the bulkhead outlet fitting 44 are formed with a threaded bore 68 designed to receive a male fitting 70 attached to the end of the hose 22. Male fitting 70 has a tubular stub section 71 that extends axially therethrough that is connected to the inner line 25 of the hose 22, the line through which the vapor flows. The annular portion of the fitting 70 that surrounds the stub section 71 serves as the flow through conduit through which the fuel flows into the outer line 24 of the hose 22. A fuel passageway 72 is formed in the bulkhead outlet fitting 44 so as to extend from the threaded bore 68 to outlet 46 of the motor chamber 35. Also formed within the bulkhead outlet fitting 44 is a vapor passageway 74 that extends from the base of the threaded bore 68 to the inlet 48 associated with the pump chamber 36. In order to ensure smooth flow through vapor passageway 74, the passageway, which has both a curved section and a straight section, is formed to have a uniform cross sectional profile along its length. The open end of vapor passageway 74 is however, formed with a increased diameter counter bore 76. Counter bore 76 is provided so that stub section 71 of male fitting 70 can be directly coupled to vapor passageway 74.

When the dispenser 10 with integral vapor recovery pump 32 of this invention is actuated, the fuel being discharged flows through the motor chamber 35 of the pipe prior to flowing through the hose 22. The flow of the fuel through the motor chamber 35 causes a suction to develop in the complementary pump chamber 36. Consequently, a suction is drawn by the pump 32 so as to result in vapor that is generated as a result of the fuel dispensing processes to be drawn into an inlet port in the nozzle 23, through the hose 22 and into the pump. The vapor is then exhausted from the vapor recovery pump back into the storage tank 16 wherein it was originally held as liquid state fuel. Thus, as fuel is discharged from dispenser 10 vapor generated as a consequence of the dispensing process is captured so as to prevent its release to the environment and is, instead, returned to the storage tank 16.

The dispenser 10 of this invention is further arranged so that the vapor recovery pump 32 is fitted directly to the side wall 33 of the dispenser and the associated coaxial hose through which the fuel and recovered vapor flow is directly connected to the pump. This arrangement eliminates the need to have plumb the inside of the dispenser 10 with a fuel-out line and a vapor-in line that serve as vapor recover pump-hose interconnectors. Moreover, the vapor recovery pump 32 is secured directly to the inside wall of the dispenser 10. Collectively these features of the invention serve to minimize the extent to which the components forming the vapor recovery system occupy space within the dispenser 10. This makes the positioning of other components in the dispenser, as well as the maintenance of the dispenser, a relatively easy task. Moreover, since the vapor recovery pump 32 is mounted directly to the side wall 33 of the housing 14, the need to provide mounting brackets for securing the pump in place is eliminated.

Still another feature of this invention is that the vapor recovery pump 32 is contained entirely within the dispenser 10. This serves to eliminate the need to provide a separate housing in order to provide the vapor recovery pump 32 with the environmental and security protection it requires. Furthermore, by placing the vapor recovery pump 32 within the dispenser 10, it no longer is exposed as a separate object that could be the subject of either accidental or intentional physical abuse.

Figure 6:
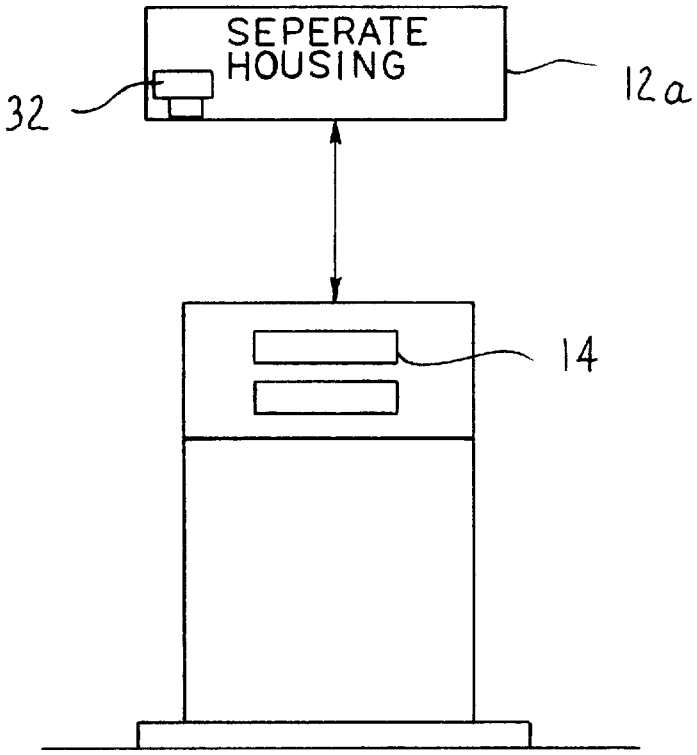
FIG. 6 is a block diagram of an alternative gasoline dispenser of this invention.

The foregoing description has been limited to a specific embodiment of the invention. It should be apparent, however, that this invention can be practiced using alternative components other than what has been specifically described. For example, in the disclosed version of the invention, the vapor recovery pump is shown as being mounted to a side wall of the dispenser. That need not always be the case. In some versions of the invention, it may be desirable to mount the vapor recovery pump to a top wall of the dispenser. Moreover, this invention may also be practiced using dispensers other than conventional, upright dispensers. This invention could be fitted into a canopy-type or high-hose dispenser 10*a*, seen in FIG. 6, where the dispenser includes a housing that is suspended above ground level by some type of upright assembly. In some, but not all, canopy-type and high-hose dispensers, the housing from which the hose extends has a separate housing 12*a* that is elevated relative to the housing containing the fuel flow control valve 26 and the flow meter 28. In these versions of the invention, the hose extends downwardly from the housing and the vapor recovery pump would be mounted so as to be secured to a side or bottom surface of the elevated housing.

Moreover, the structure of the vapor recovery pump may differ from what has been described. For example, in some versions of the invention the bulkhead outlet fitting may be integrally formed with the pump body. Also, in some versions of the invention, the bulkhead fitting may be constructed so that vapor passageway is essentially an axial flow through passageway and the fuel passageway is the one that is offset from the axis along which the hose is coupled to the pump. Furthermore, it may also be desirable to practice this invention with vapor recovery pumps and complementary hoses that are arranged so that fuel is discharged through the center of the hose and the vapor is drawn back into the dispenser through a line that is either coaxial with or tandem with the line through which the fuel flows.

Therefore, it is an object of the appended claims to cover all such modifications and variations as come within the true spirit and scope of the invention.

The embodiments of the invention in which an exclusive property or privilege is claimed are defined as follows:

1. A fuel dispenser for dispensing liquid-state fuel from a storage tank, said dispenser including:

a dispenser housing having walls, one of said walls being formed with an opening;

a fuel supply line connected from the storage tank to said dispenser housing;

a control valve disposed in said dispenser housing and connected to said fuel supply line for regulating fuel flow through said fuel supply line;

a flow meter disposed in said dispenser housing and connected to said fuel supply line for metering the flow of fuel through said fuel supply line;

a vapor recovery pump disposed in said dispenser housing and secured to said wall forming said opening so as to be located adjacent said opening, said vapor recovery pump having a pump chamber with a vapor inlet port and a vapor exhaust port, a motor chamber having a liquid inlet port and a liquid outlet port, a pump shaft extending between said motor chamber and said pump chamber, said pump shaft being configured to rotate in response to liquid flow through said motor chamber so as to cause a suction to develop in said pump chamber, wherein said fuel supply line is connected to said liquid inlet port of said motor chamber so as to introduce fuel into said motor chamber and a bulkhead member that defines a vapor passageway that extends to said vapor inlet port of said pump chamber and a fuel passageway that extends from said liquid outlet port of said motor chamber, said bulkhead member being formed with an outwardly extending boss wherein said vapor passageway and said fuel passageway extend from a common bore formed in said boss and said bulkhead member is positioned relative to said wall of said dispenser housing to which said vapor recovery pump is attached so that said boss extends through said opening formed in said wall of said dispenser housing;

a vapor recovery line extending from said vapor exhaust port of said pump chamber to the storage tank; and a two-line fuel hose connected to said common bore of said boss of said vapor recovery pump so that said fuel hose extends away from said opening formed in said wall of said dispenser housing, said fuel hose having a fuel line connected to said fuel passageway in said bulkhead member of said vapor recovery pump through which fuel from said motor chamber is discharged and a vapor line connected to said vapor passageway of said bulkhead member through which vapor is drawn into said pump chamber.

2. The fuel dispenser according to claim 1, wherein:

said common bore formed in said boss has internal threading; and said fuel hose is formed as a coaxial fuel hose wherein one of said lines is an inner line and the other said line is an outer line that surrounds said inner line and an externally threaded coupling integral with said fuel hose is attached to said boss of said bulkhead member of said vapor recovery pump for coupling said fuel line to said fuel passageway in said bulkhead member and for coupling said vapor line to said vapor passageway in said bulkhead member, said coupling having a tubular stub in fluid communication with said inner line for connecting said inner line to said passageway with which said inner line is in fluid communication.

3. The fuel dispenser of claim 2, wherein said inner line functions as said vapor line and said outer line functions as said fuel line.

4. The fuel dispenser according to claim 1, wherein said bulkhead member of said vapor recovery pump is formed with a surface that abuts said wall of said dispenser housing adjacent said opening and at least one fastener extends through said wall into said bulkhead member for securing said vapor recovery pump to said dispenser housing.

5. The fuel dispenser of claim 1, wherein said common bore of said boss is substantially coaxially aligned with said liquid outlet port of said motor chamber of said vapor recovery pump.

6. The fuel dispenser of claim 1, wherein said fuel hose extends horizontally out of said dispenser housing.

7. The fuel dispenser of claim 1, wherein said dispenser housing has a lower section in which said control valve and said flow meter are disposed and an upper section located above said lower section, said upper section having at least one wall that is separate from said walls defining said lower section, wherein said vapor recovery pump is mounted to said wall of said upper section and said two-line fuel hose extends away from said wall of said upper section.

8. The fuel dispenser of claim 7, wherein said upper section of said dispenser housing is physically separate from said lower section of said dispenser housing.

9. The fuel dispenser of claim 1, wherein said wall of said dispenser housing in which said opening is formed and to which said vapor recovery pump is attached is a side wall of said dispenser housing.

10. The fuel dispenser of claim 1, wherein said vapor recovery pump is formed with a main body in which said motor chamber and said pump chamber are defined and said bulkhead member is a separate component from said main body.

11. A fuel dispensing system for dispensing liquid-state fuel from a storage tank, said fuel dispensing system including:

a dispenser housing having walls, one of said walls having an opening;

a fuel supply line extending from the storage tank to said dispenser housing, a flow meter disposed in said dispenser housing and attached to said fuel supply line for metering fuel flow through said fuel supply line;

a two-line fuel hose extending from said dispenser housing, said fuel hose having a fuel line and a vapor line;

a vapor recovery pump disposed in said dispenser housing so as to be secured to said wall in which said opening is formed, said vapor recover pump having:

a main body formed to define a motor chamber having a liquid inlet port and a liquid outlet port and a pump chamber having a vapor inlet port and a vapor exhaust port, said main body having a rotating pump shaft disposed therein that extends between said motor chamber and that rotates in response to liquid flow through said motor chamber so as to cause a suction to develop in said pump chamber, wherein said fuel supply line is connected to said liquid inlet port; and a bulkhead member coupled to said main body, said bulkhead member being formed to define a fuel passageway that extends from said liquid outlet port and a vapor passageway that extends from said vapor inlet port, said bulkhead member being further shaped to have an outwardly extending boss, said boss being formed with a common bore from which said fuel passageway and said vapor passageway extend, wherein said vapor recovery pump is mounted to said wall so that said boss extends through said opening and said fuel hose is attached to said boss so that said fuel line is in fluid communication with said fuel passageway and said vapor line is in fluid communication with said vapor passageway; and a vapor recovery line extending from said vapor exhaust port of said pump chamber to the storage tank.

12. The fuel dispensing system according to claim 11, wherein said fuel hose is formed as a coaxial fuel hose wherein one of said lines is an inner line and the other said line is an outer line that surrounds said inner line and said fuel hose is provided with a coupling that is seated in said common bore of said boss for coupling said fuel line to said fuel passageway and for coupling said vapor line to said vapor passageway.

13. The fuel dispensing system according to claim 12, wherein said inner line functions as said vapor line and said outer line functions as said fuel line.

14. The fuel dispensing system according to claim 12, wherein: said common bore formed in said boss has internal threading; and said coupling of said fuel hose is formed with external threading designed to engage said threading around said common bore.

15. The fuel dispensing system according to claim 12, wherein said coupling has a tubular stub in fluid communication with said inner line for connecting said inner line to said passageway with which said inner line is in fluid communication.

16. The fuel dispensing system according to claim 11, wherein said bulkhead member of said vapor recovery pump is formed with a surface that abuts said wall of said dispenser housing adjacent said opening and at least one fastener extends through said wall into said bulkhead member for securing said vapor recovery pump to said dispenser housing.

17. The fuel dispensing system of claim 11, wherein said common bore of said boss is substantially aligned with said liquid outlet port of said motor chamber.

18. The fuel dispensing system of claim 11, wherein said fuel hose extends horizontally out of said dispenser housing.

19. The fuel dispenser of claim 11, wherein said dispenser housing is formed to have a lower section and an upper section having at least one wall that is separate from said walls defining said lower section, wherein said vapor recovery pump is mounted to one of said walls of said upper section so that said boss and said common bore formed therein extend through one of said walls of said upper section and said fuel hose extends away from said wall of said upper section.

20. The fuel dispensing system of claim 19, wherein said flow meter is located in said lower section of said dispenser housing.

21. The fuel dispensing system of claim 19, wherein said upper section of dispenser housing is physically separate from said lower section of said dispenser housing.

22. The fuel dispensing system of claim 11, wherein said wall of said dispenser housing in which said opening is formed and to which said vapor recovery pump is attached is a side wall of said dispenser housing.

23. The fuel dispensing system of claim 11, wherein said main body and said bulkhead member of said vapor recovery pump are separate components.

24. The fuel dispensing system of claim 11, wherein said bulkhead member is formed with a counterbore that extends from said common bore and said counterbore provides a fluid communication path from said vapor passageway to said common bore.

* * * * *